US008256985B2

(12) United States Patent
Ashmead

(10) Patent No.: US 8,256,985 B2
(45) Date of Patent: Sep. 4, 2012

(54) BARRIER

(75) Inventor: Michael Ashmead, Huntingdon (GB)

(73) Assignee: Cellbond Limited, Cambridgshire (GB)

( * ) Notice: Subject to any disclaimer, the term of this patent is extended or adjusted under 35 U.S.C. 154(b) by 0 days.

(21) Appl. No.: 12/667,361

(22) PCT Filed: Jul. 4, 2008

(86) PCT No.: PCT/GB2008/002311
§ 371 (c)(1),
(2), (4) Date: Apr. 28, 2010

(87) PCT Pub. No.: WO2009/007695
PCT Pub. Date: Jan. 15, 2009

(65) Prior Publication Data

US 2010/0202828 A1 Aug. 12, 2010

(30) Foreign Application Priority Data

Jul. 6, 2007 (GB) ..... 0713167.5

(51) Int. Cl.
*E01F 13/02* (2006.01)

(52) U.S. Cl. ..... 404/6

(58) Field of Classification Search ..... 404/6, 9; 116/63 C, 63 T
See application file for complete search history.

(56) References Cited

U.S. PATENT DOCUMENTS

| | | | | |
|---|---|---|---|---|
| 2,723,817 | A | 11/1955 | Harwood et al. | |
| 3,690,620 | A | 9/1972 | Matson et al. | |
| 3,917,231 | A * | 11/1975 | Fink | 256/64 |
| 4,104,980 | A | 8/1978 | Toomey | |
| 4,817,318 | A | 4/1989 | Strauch | |
| 5,382,112 | A | 1/1995 | Fu | |
| 5,501,429 | A * | 3/1996 | Sakuma | 256/1 |
| 6,053,657 | A * | 4/2000 | Signorelli | 404/6 |
| 6,119,621 | A * | 9/2000 | Johnson | 116/63 C |
| 6,334,736 | B1 * | 1/2002 | Johnson et al. | 405/114 |
| 6,517,280 | B2 * | 2/2003 | Carter | 404/6 |
| 6,971,329 | B1 | 12/2005 | Stewart | |
| 7,712,998 | B2 * | 5/2010 | Salemie | 405/111 |
| 7,802,605 | B2 * | 9/2010 | Prismall | 160/24 |
| 7,823,526 | B2 * | 11/2010 | Julnes | 116/63 C |
| 2003/0033742 | A1 * | 2/2003 | Perelli et al. | 40/606 |
| 2004/0060499 | A1 * | 4/2004 | Penque, Jr. | 116/63 P |

FOREIGN PATENT DOCUMENTS

| | | | |
|---|---|---|---|
| DE | 2148165 | | 4/1973 |
| EP | 0823510 | A2 | 2/1998 |
| GB | 2027780 | A | 2/1980 |
| GB | 2346403 | A | 8/2000 |
| WO | WO/92/21822 | A1 | 12/1992 |

* cited by examiner

*Primary Examiner* — Raymond W Addie
(74) *Attorney, Agent, or Firm* — Kilpatrick Townsend & Stockton LLP

(57) ABSTRACT

A collapsible barrier (10) comprises: a first pair of members (12,14) pivotally coupled together at a first coupling (16); and a second pair of members (18, 20) pivotally coupled together at a second coupling (22); wherein each member (12, 14) of the first pair is pivotally coupled at a respective lateral coupling (24, 26) to a corresponding member (18, 20) of the second pair such that the members (12, 14, 18, 20) are movable from an erected configuration where the members of the first pair are mutually inclined at a first angular separation, and a collapsed configuration where the members of the first pair are mutually inclined at a second angular separation which is less than the first angular separation.

14 Claims, 9 Drawing Sheets

ERECTED CONFIGURATION

COLLAPSED CONFIGURATION

BARRIER

The present invention relates to a barrier, particularly but not exclusively a collapsible barrier for temporary deployment, for example for use in demarking a traffic lane during road construction or maintenance, for use as a crash barrier or for use in flood prevention.

Temporary road barriers are known from U.S. Pat. No. 4,104,980 and U.S. Pat. No. 5,382,112. Both documents disclose barriers comprising two frames each with a pair of legs. The frames are pivotally coupled together, allowing the barrier to be folded flat when not in use, and to be subsequently deployed simply by pivoting one frame relative to the other. However, neither barrier has a particularly sturdy appearance. U.S. Pat. No. 4,104,980 discloses the use of a collapsible bunk suspended between the frames for receiving ballast, and U.S. Pat. No. 5,382,112 discloses the use of a roller blind between one pair of legs for displaying a warning message.

Collapsible barriers are also known for temporary deployment to protect against flooding from rivers and tidal surges. Such barriers are typically channel-and-panel arrangements, with the channels being configured to slidingly receive one or more panels to form a wall. The channels are either integrally formed in posts anchored to the ground or are fitted around building openings, such as doorways.

In accordance with the present invention, there is provided a collapsible barrier comprising a first pair of members pivotally coupled together at a first coupling and a second pair of members pivotally coupled together at a second coupling wherein each member of the first pair is pivotally coupled at a respective lateral coupling to a corresponding member of the second pair such that the members are movable from an erected configuration where the members of the first pair are mutually inclined and held at first angular separation, and a collapsed configuration where the members of the first pair are mutually inclined at a second angular separation which is less than the first angular separation.

With such a collapsible barrier, the members may each be configured as rigid linkages which control the shape of the barrier in both the erected and collapsed configurations. In such an arrangement, any pivotal movement between the members of the first pair produces a complementary move in members of the second pair. In the erected configuration, the first angle may be the maximum angular displacement permitted by the second pair of members. In the collapsed configuration, the second angle may be very small, e.g. less than 10°, and may even be substantially zero, so that the members of the first pair will rest substantially side by side, thereby minimising the footprint of the barrier for storage or transportation.

Alternatively, each member of one pair of members may be configured to change shape as the collapsible barrier moves between the collapsed and erected configurations. For example, the first pair of members may change shape as the collapsible barrier is deployed. Each member of said one pair of members may be resiliently flexible and configured to change shape by flexure (elastic deformation). Alternatively, each member of said one pair may each comprise two parts pivotally coupled together, with each member being configured to change shape by pivotal movement of one of its two parts relative to the other. Such a change in shape may allow a collapsible barrier to be designed with a profile in the erect configuration which is more sheer at its base (i.e. perpendicular to the ground on which it stands) than might otherwise be the case. Such "sheerness" may be an important consideration when designing a collapsible barrier to withstand lateral or side impacts from an object (e.g. a car) without deflecting the object upwards and over the barrier.

The collapsible barrier may further comprise a bracing mechanism to support at least one pair of members when in the erected configuration. For example, the bracing mechanism may in use extend between the first pair of members, spaced from both the first coupling and the lateral couplings. The bracing mechanism may be movable between an active configuration and an inactive configuration. The bracing mechanism may be configured to deploy in sympathy with the collapsible barrier, adopting the active configuration as the collapsible barrier is moved into the erected configuration. The bracing mechanism may comprise a pair of linkages pivotally coupled together, with one end of each linkage being pivotally coupled to a respective one of the pair of members supported when the collapsible barrier is in the erected configuration. The bracing mechanism may further comprise at least one variable length strut which is configured to urge the pair of linkages into a linear configuration when the collapsible barrier is in the erected configuration. One end of the at least one variable length strut may be pivotally coupled to the second coupling, and the other end may be pivotally coupled to one of the pair of linkages where that one linkage is pivotally coupled to its respective member.

The members may be panel-form, for example panels of plastics material or sheet metal. In the erected configuration, the panel-form members define a free-standing three-dimensional structure with an open-ended chamber therebetween. The open-ended chamber may be substantially triangular or pentagonal in cross-section, and may be suitable for receiving ballast. A bladder may be provided in the open-ended chamber for receiving liquid (e.g. water) ballast. The bladder may comprise a non-return valve which is configured to permit ingress of water from outside the barrier and to resist egress of water ballast. Such an arrangement may be very useful in flood defence applications.

In one embodiment, the first, second and lateral couplings each have a respective pivot axis, with the pivot axes being parallel to one another.

In one embodiment, a part of one member of the second pair extends to one lateral side of its lateral coupling with the corresponding member of the first pair. In such an arrangement, the part forms a protruding flange when the members are in the erected configuration, which may assist with anchoring the barrier to the ground or attaching the barrier to an adjacent barrier. The part may also be configured to extend far enough away from the first pair of members in the erected configuration (e.g. by about 1 meter or more) to make contact with a car's tyres before another part of the car makes contact with the first pair of members during a head-on collision.

The barrier may be biased to move from the erected configuration to the collapsed configuration when lifted vertically by one or the other member of the first pair. The bias may be gravity-based, relying on weight of members to drive the move from the erected configuration to the collapsed configuration.

The collapsible barrier may further comprise at least one part of an attachment mechanism at one axial end thereof for engaging an adjacent collapsible barrier. The at least one part of the attachment mechanism may, in use, extend from the axial end of the collapsible barrier, and may be retractable when not in use. The at least one part of the attachment mechanism may move relative to the members of the collapsible barrier in at least one direction to provide a locking action after engagement with an adjacent collapsible barrier. Such secure engagement is resistant to accidental disengagement during impact with an object such as a car. The collapsible barrier may comprise at least part of an attachment mechanism at each axial end thereof. The attachment mechanisms (or parts thereof) may be complementary, and may have corresponding profiles so that two identical barriers may be readily attached together in series.

Embodiments of the invention will now be described by way of example with reference to the accompanying drawings in which.

Figure 9A:
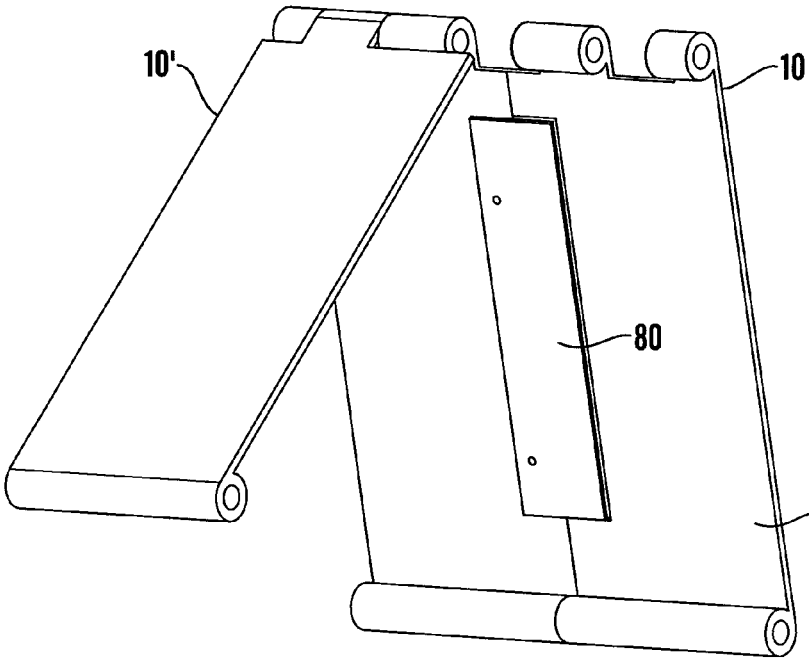
Figure 9B:
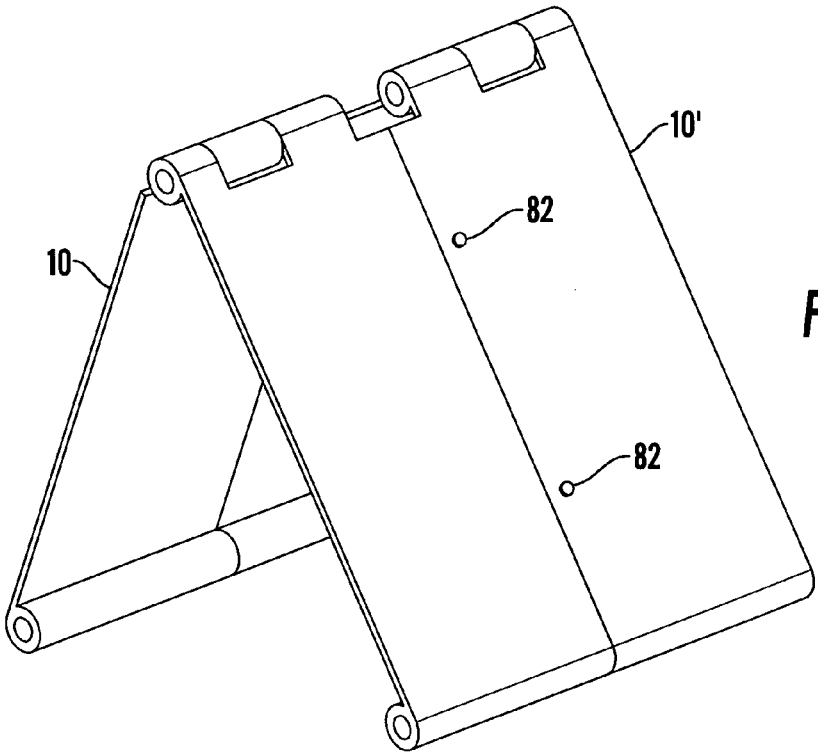
Figure 10A:
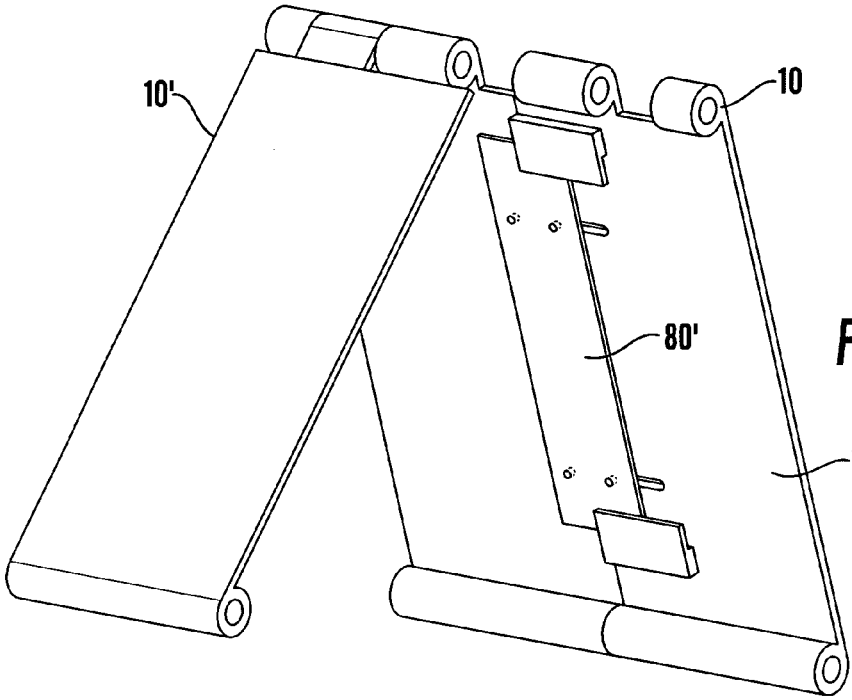
Figure 10B:
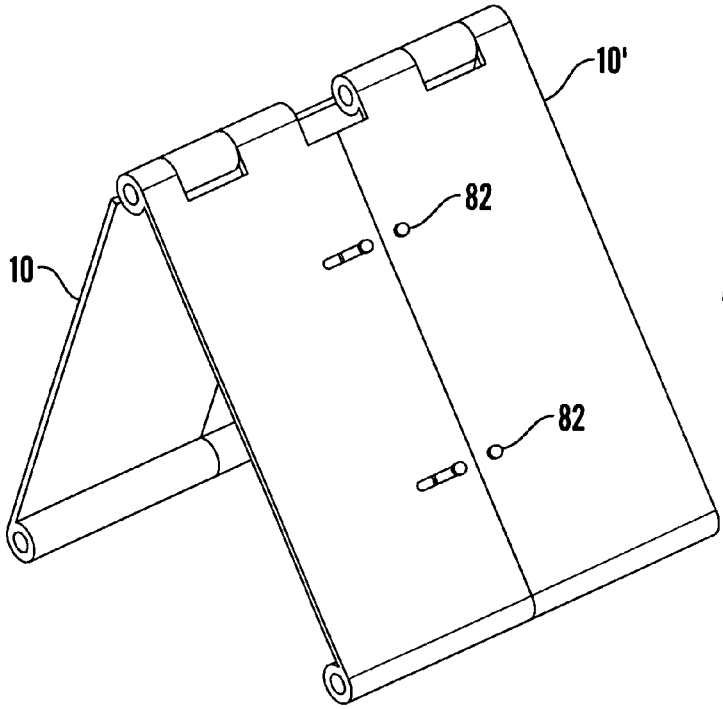
Figure 11:
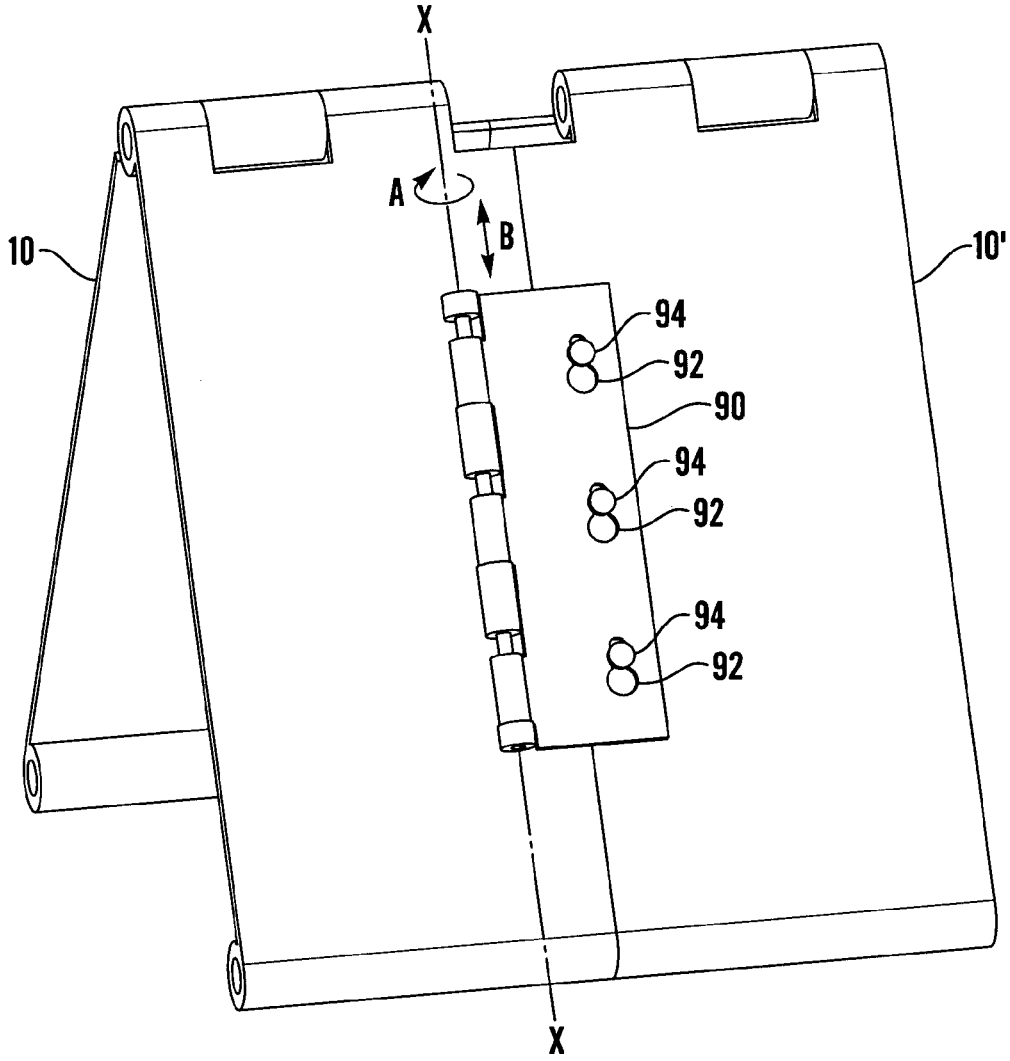

FIGS. 9*a* and 9*b* are partial perspective views of a barrier illustrating one form of attachment detail;

FIGS. 10*a* and 10*b* are partial perspective views of a barrier illustrating another form of attachment detail; and FIG. 11 is a partial perspective view of a barrier illustrating yet another form of attachment detail.

Figure 1:
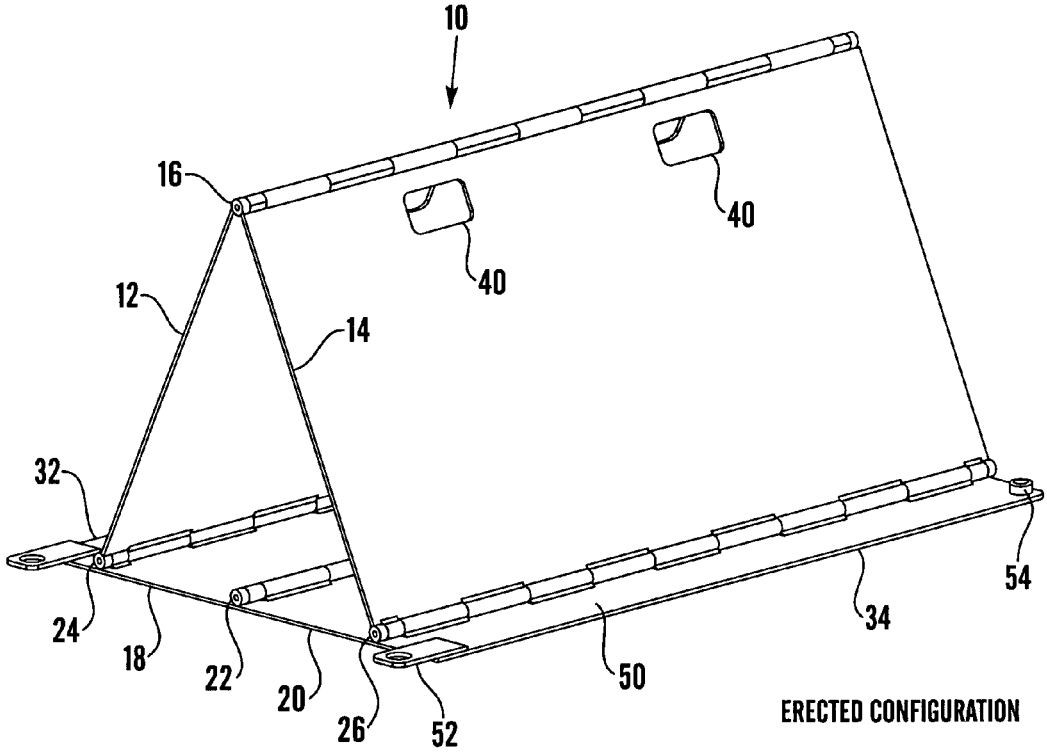
FIG. 1 is a perspective view of a barrier in use according to a first embodiment of the present invention.

FIG. 1 illustrates a perspective view of a self-supporting collapsible barrier 10 in an erected configuration. The barrier 10 comprises a first pair of members 12, 14 pivotally coupled together at first coupling or hinge 16, and a second pair of members 18, 20 pivotally coupled together at a second coupling or hinge 22. Each of the members 12, 14, 18 and 20 is a rigid panel. Each member 12, 14 of the first pair is pivotally coupled to a corresponding member 18, 20 at a respective lateral coupling or hinge 24, 26. The pivot axes of the couplings 16, 22, 24 and 26 are parallel to one another, and allow the members 12, 14, 18 and 20 of the collapsible barrier to move into a collapsed configuration (see below).

Figure 2:
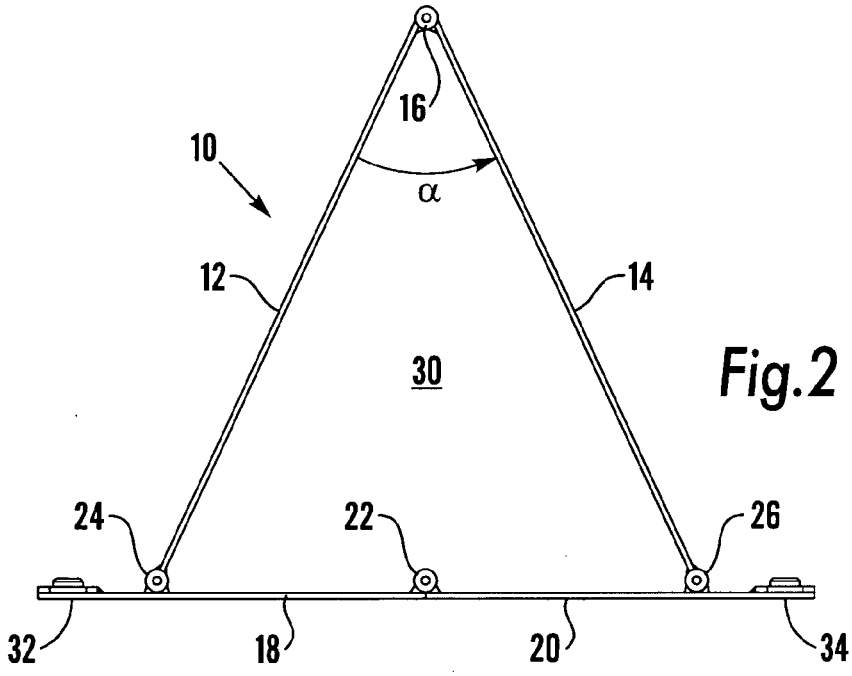
FIG. 2 is an end view of the barrier of FIG. 1 in an erected configuration.
Figure 3:
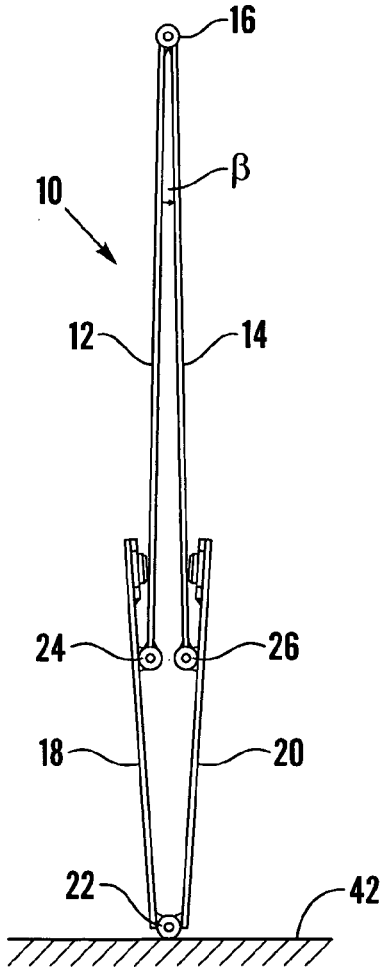
FIG. 3 is an end view of the barrier of FIG. 1 in a collapsed configuration.
Figure 4:
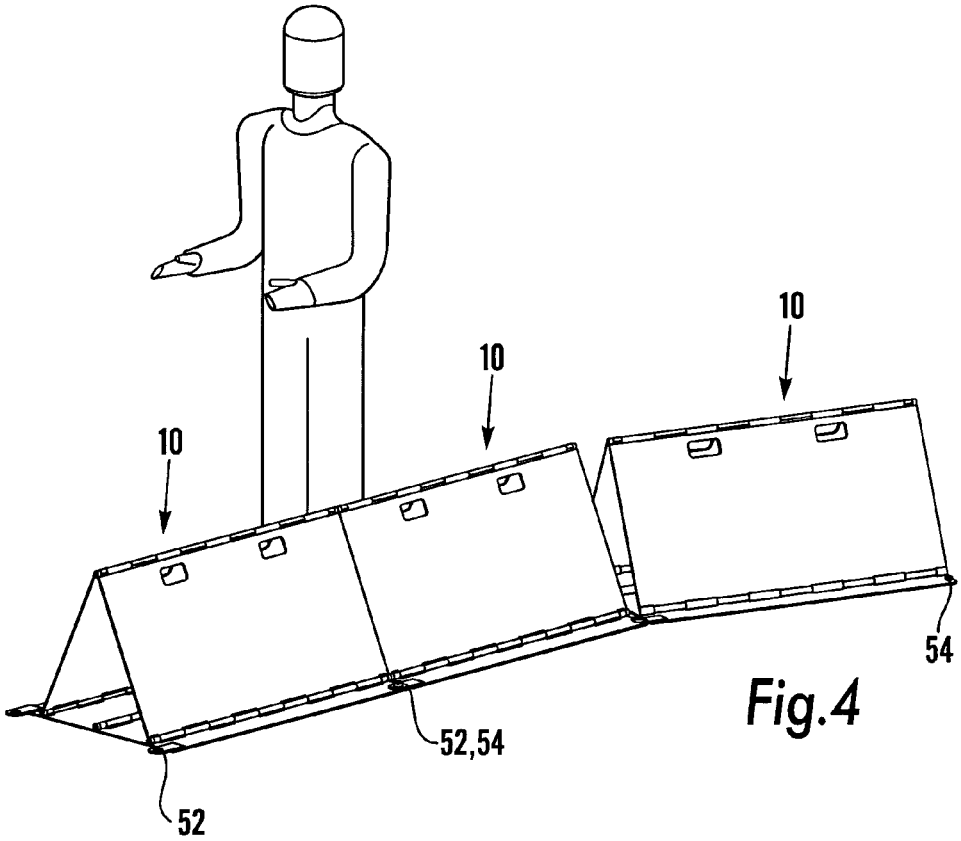
FIG. 4 illustrates schematically use of barriers each according to FIG. 1.

Referring to FIGS. 2 and 3, it is clear that in the erected configuration the members 12, 14, 18 and 20 define a free-standing self-supporting structure with an open-ended chamber 30 therebetween of triangular cross-section. The second pair of members 18, 20 are co-planar and define a ground-engaging supporting base for the first pair of members 12, 14. Each member 18, 20 of the second pair extends partly to one lateral side of its respective lateral coupling 24, 26 with its corresponding member 12, 14 of the first pair, giving rise to protruding flanges 32, 34. The flanges 32, 34 increase the effective footprint of the barrier increasing stability and topple resistance. In other words, lateral couplings 24, 26 are each located on a planar face of members 18, 20 rather than along an edge thereof. The spacing between the second coupling 22 and the lateral couplings 24, 26 controls the maximum angular separation $\alpha$ of the members 12, 14 of the first pair.

On vertically lifting the barrier 10 using handles 40 cut into the first pair of members 12, 14, the members 12, 14, 18 and 20 adopt the collapsed configuration under their own weight. The second coupling 22 moves as far as possible from the first coupling 16, pulling the first pair of members 12, 14 together so as to reduce their angular separation $\beta$ to a minimum. The barrier 10 may be restored to its erected configuration simply by lowering the second coupling 22 onto the ground 42 and allowing the first pair of members 12, 14 and the second pair of members 18, 20 to fold outwardly under their own weight.

The flanges 32, 34 include preformed apertures 50, for securing the barrier 10 to the ground, e.g. using ground-spikes. The flanges 32, 34 also include mating tabs 52, 54 for joining adjacent barriers together, end to end. Waterproof seals (not shown) may be provided between abutting ends of adjacent barriers 10 to provide a flood barrier.

Figure 5:
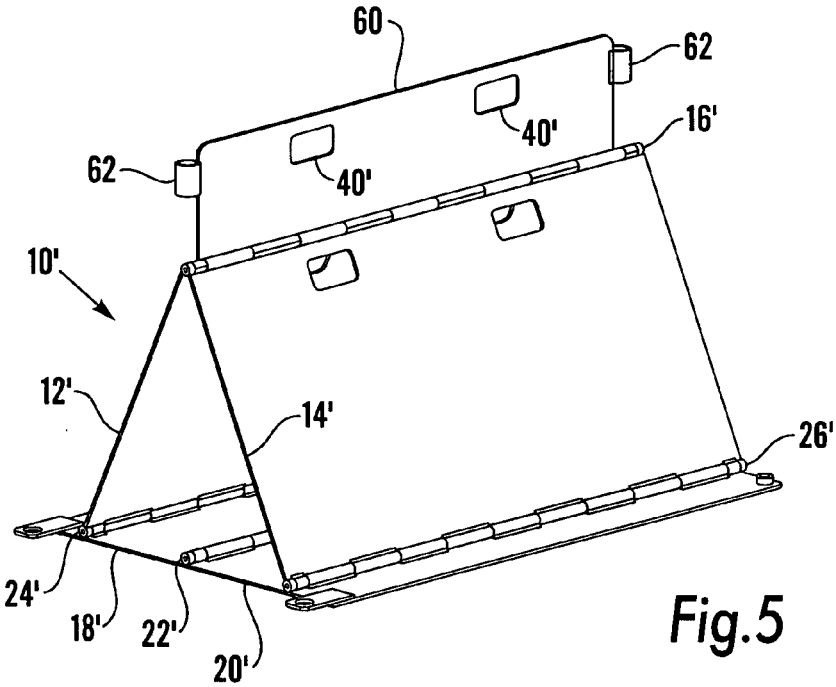
FIG. 5 is a perspective view of a barrier in use according to a second embodiment of the present invention.

FIG. 5 illustrates a further embodiment of a barrier 10'. Features in common with the embodiment of FIGS. 1-4 share the same reference number with a prime suffix. The member 12' includes an upstanding flange 60 which protrudes above the first coupling 16'. The handles 40' are located in the flange 60. Additional brackets 62 are provided for coupling such barriers together.

Figure 6:
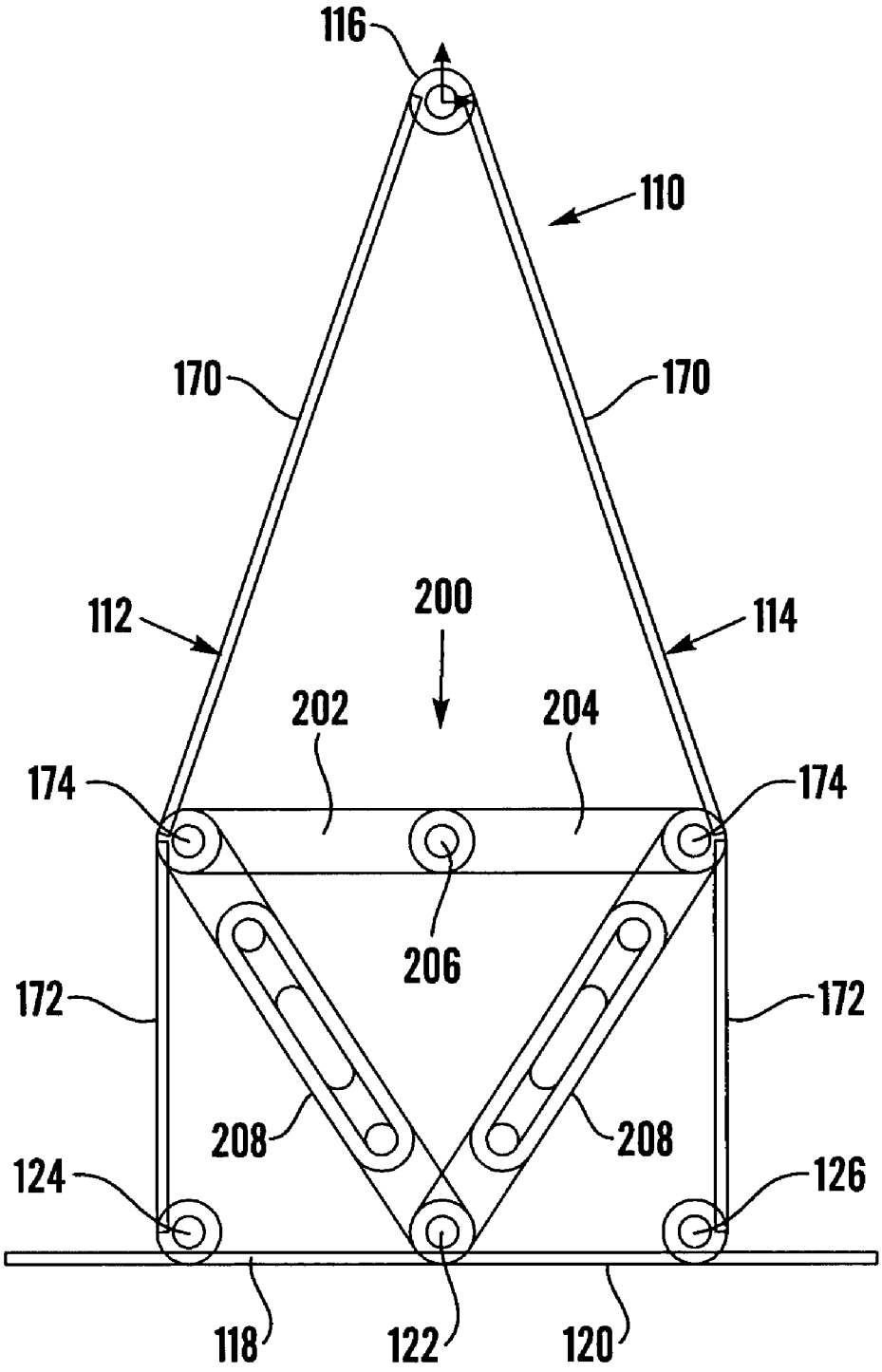
FIG. 6 is a sectional view of a barrier according to another aspect of the invention, in an erected configuration.
Figure 7:
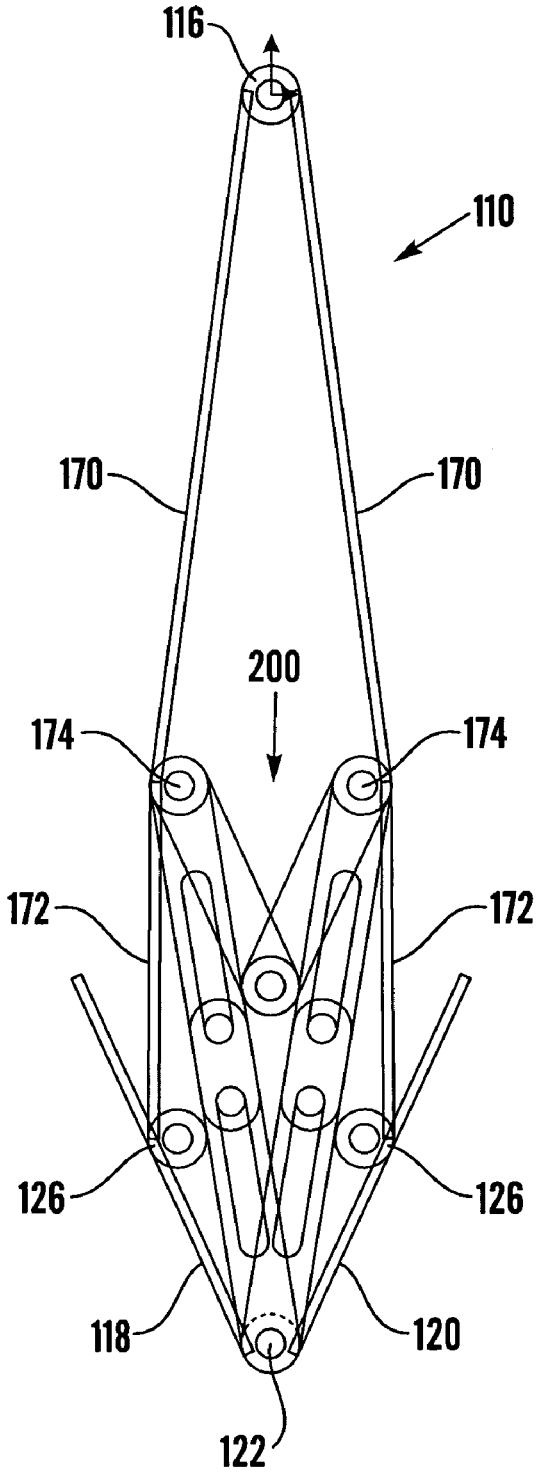
FIG. 7 is a sectional view of the barrier of FIG. 6 in a collapsed configuration.

FIG. 6 illustrates a cross-sectional view of a collapsible barrier 110 in an erected configuration. The collapsible barrier 110 comprises a first pair of members 112, 114 pivotally coupled at first coupling 116 and a second pair of members 118, 120 pivotally coupled at a second coupling 122. Each member 112, 114 of the first pair is pivotally coupled to a corresponding member 118, 120 of the second pair at a respective lateral coupling 124, 126. The first pair of members 112, 114 each comprise two parts 170, 172 pivotally coupled at intermediate coupling 174. The pivot axes of the couplings 116, 122, 124, 126 and 174 are parallel and allow the members 112, 114, 118 and 120 of the collapsible barrier to move into a collapsed configuration (see FIG. 7 below). In so moving, the first pair of members 112, 114 change shape, as parts 170, 172 pivot about intermediate couplings 174, adopting a more planar profile in the collapsed configuration.

Figure 8:
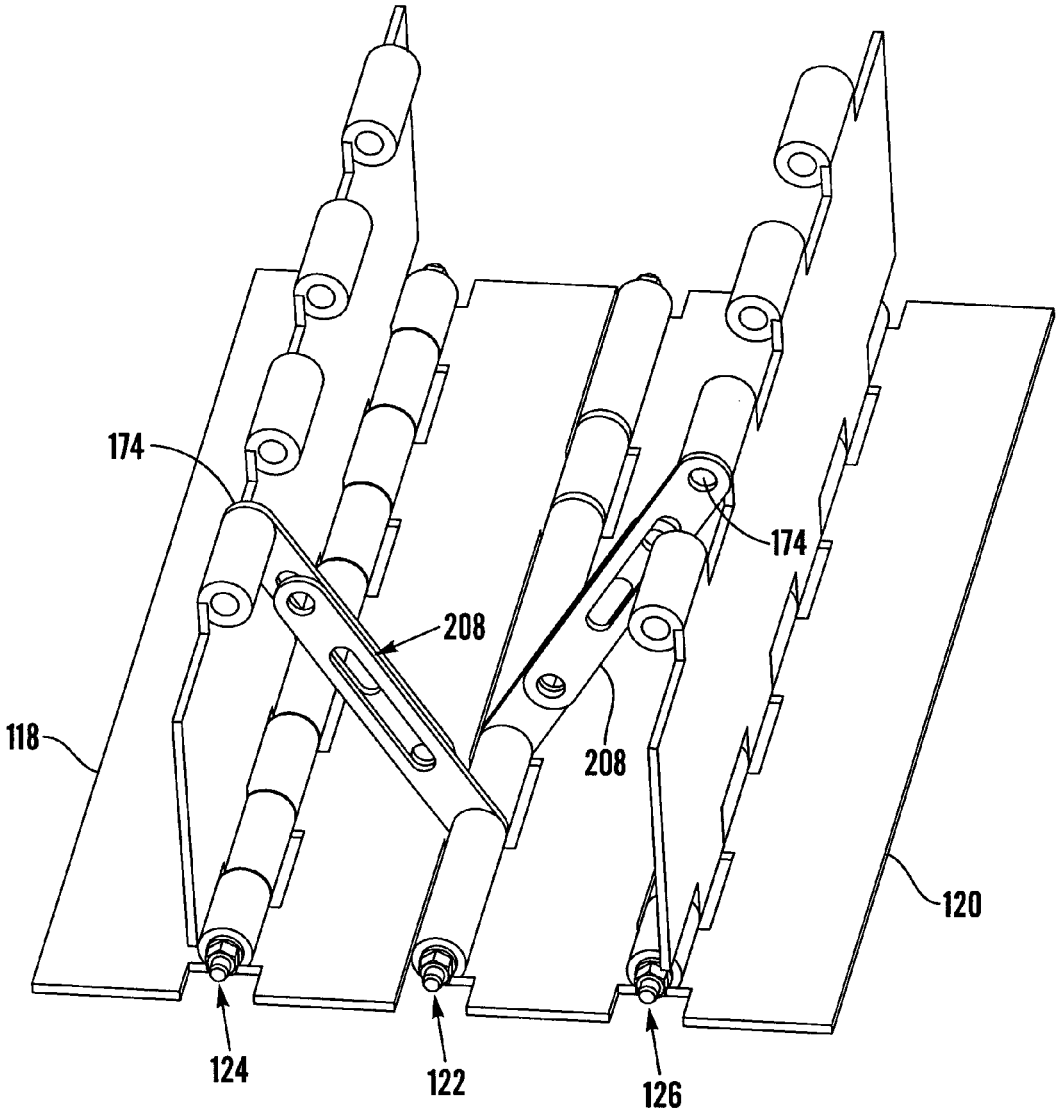
FIG. 8 is a partial cutaway perspective view of the barrier of FIG. 6 showing bracing mechanism detail.

The collapsible barrier 110 further comprises a bracing mechanism 200 for supporting the first pair of members 112, 114 in the erected configuration. The bracing mechanism 200 comprises a pair of linkages 202, 204 pivotally coupled together at linkage coupling 206, One end of each linkage 202, 204 is pivotally coupled to a respective one of the first pair of members 112, 114 at intermediate coupling 174. The bracing mechanism 200 further comprises a pair of variable length struts 208, each of which is pivotally coupled at one end to the second coupling 122 and pivotally coupled at the other end to one of the intermediate couplings 174. In the erected configuration, the bracing mechanism 200 supports the first pair of members 112, 114, with the linkages 202, 204 parallel to the second pair of members 118, 120 and with the variable length struts 208 of length $L_1$. In moving to the collapsed configuration, the bracing mechanism 200 collapses in sympathy with the barrier 110, with linkages 202, 204 pivoting about linkage coupling 206, and with variable length struts 208 extending to length $L_2$. FIG. 8 illustrates schematically how the variable length struts 208 are axially staggered or spaced apart to avoid fouling each other as the bracing mechanism 200 collapses.

FIGS. 9*a* and 9*b* illustrate schematically another way of joining adjacent barriers 10, 10' together, instead of with mating tabs 52, 54. A plate 80 is mounted on one of the first pair of members 12, 14 and extends axially therefrom. The plate 80 has pins or bolts 82 extending therefrom which engage corresponding apertures (not shown) in the adjacent barrier 10'. FIGS. 10*a* and 10*b* illustrate schematically a modified form of the apparatus of FIGS. 9*a* and 9*b*. The plate 80' is slidably mounted on one of the first pair of members 12, 14 and thus is retractable (into the chamber 30) when not in use.

FIG. 11 illustrates yet another way of joining adjacent barriers 10, 10'. A plate 90 is pivotally mounted on one of the first pair of members 12, 14 in such a way that it is movable both around (in direction of arrow A) and parallel to (in direction of arrow B) its pivot axis XX. The plate 90 has "key-hole" apertures 92 which are elongate and wider at one end than the other. The key-hole" apertures are aligned parallel to the pivot axis of the plate 90. The adjacent barrier 10' has pins 94 each with an enlarged head which fits through the widest part of each aperture 92, but not through the narrowest part. The apertures 92 and pins 94 are configured to register in such a way that the pins 94 pass through the widest part of the apertures 92 when the plate 90 is aligned in a first position. The apertures 92 and pins 94 are further configured to lock once registered by moving the plate 90 parallel to its pivot axis (e.g. in a downward direction) to a second position where the pins 94 are registered with the narrowest part of the apertures 92.

The invention claimed is:

1. A collapsible barrier for use as a crash barrier comprising:

a first pair of members pivotally coupled together at a first coupling; and a second pair of members pivotally coupled together at a second coupling;

wherein each member of the first pair is pivotally coupled at a respective lateral coupling to a corresponding member of the second pair, with the first, second and lateral couplings having parallel pivot axes such that the members are movable from an erected configuration where the members define a free-standing three-dimensional structure with an open-ended chamber therebetween, with the first pair of members mutually inclined at a first angular separation, to a collapsed configuration where the members of the first pair are mutually inclined at a second angular separation which is less than the first angular separation;

wherein the members are biased to move from the erected configuration to the collapsed configuration when one or the other member of the first pair is lifted vertically, with the second coupling moving as far as possible from the first coupling as the members move from the erected configuration to the collapsed configuration; and wherein at least one part of an attached mechanism is provided at each axial end of the collapsible barrier for joining adjacent collapsible barriers together, end to end, when in the erected configuration.

2. A collapsible barrier according to claim 1, in which the members are configured as rigid linkages which control the shape of the barrier in both the erected and collapsed configurations.

3. A collapsible barrier according to claim 2, in which the first angular separation is the maximum angular separation permitted by the second pair of members.

4. A collapsible barrier according to claim 1, in which the second angular separation is less than 10° .

5. A collapsible barrier according to claim 1, in which each member of one pair of members is configured to change shape as the collapsible barrier moves between the collapsed and erected configurations.

6. A collapsible barrier according to claim 5, in which each member of said one pair comprises two parts pivotally coupled together, with pivotal movement of one part relative to the other having a shape changing effect.

7. A collapsible barrier according to claim 1, further comprising a bracing mechanism for supporting at least one pair of members when the collapsible barrier is in the erected configuration.

8. A collapsible barrier according to claim 7, in which the bracing mechanism is movable between an active configuration and an inactive configuration, and deploys in sympathy with the collapsible barrier, adopting the active configuration as the collapsible barrier is moved into the erect configuration.

9. A collapsible barrier according to claim 7, in which the bracing mechanism comprises a pair of linkages pivotally coupled together, with one end of each linkage being pivotally coupled to a respective one of the pair of members supported when the collapsible barrier is in the erected configuration.

10. A collapsible barrier according to claim 9, in which the bracing mechanism comprises at least one variable length strut, pivotally coupled at one end to the second coupling and at the other end to one of the linkages.

11. A collapsible barrier according to claim 1, in which the members are panel-form.

12. A collapsible barrier according to claim 1, in which a part of one member of the second pair extends to one lateral side of its lateral coupling with the corresponding member of the first pair.

13. A collapsible barrier according to claim 1, in which the at least one part of the attachment mechanism is retractable.

14. A collapsible barrier according to claim 1 in which the at least one part of the attachment mechanism is configured to move relative to the pairs of members of the collapsible barrier in at least one direction to provide a locking action after engagement with an adjacent collapsible barrier.

* * * * *